US010865784B2

(12) United States Patent
Kim et al.

(10) Patent No.: US 10,865,784 B2
(45) **Date of Patent: *Dec. 15, 2020**

(54) LINEAR COMPRESSOR

(71) Applicant: LG ELECTRONICS INC., Seoul (KR)

(72) Inventors: Hyunsoo Kim, Seoul (KR); Geonwoo Kim, Seoul (KR); Chulgi Roh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/535,625

(22) Filed: Aug. 8, 2019

(65) Prior Publication Data

US 2019/0360479 A1 Nov. 28, 2019

Related U.S. Application Data

(63) Continuation of application No. 15/804,142, filed on Nov. 6, 2017, now Pat. No. 10,527,032.

(30) Foreign Application Priority Data

Jun. 21, 2017 (KR) ..... 10-2017-0078612

(51) Int. Cl.
*F04B 39/12* (2006.01)
*F04B 35/04* (2006.01)
(Continued)

(52) U.S. Cl.
CPC ..... *F04B 39/125* (2013.01); *F04B 35/04* (2013.01); *F04B 35/045* (2013.01);
(Continued)

(58) Field of Classification Search
CPC .... F04B 39/121; F04B 39/122; F04B 39/127; F04B 39/126
(Continued)

(56) References Cited

U.S. PATENT DOCUMENTS 3,250,461 A * 5/1966 Parker ..... F25B 31/023 417/312
3,545,891 A * 12/1970 Parker ..... F25B 31/02 417/372
(Continued)

FOREIGN PATENT DOCUMENTS

CN 101205891 6/2008
CN 105298793 2/2016
(Continued)

OTHER PUBLICATIONS

European Search Report dated May 11, 2018 issued in EP Application No. 18151985.1.
(Continued)

*Primary Examiner* — Michael Leslie
*Assistant Examiner* — Matthew Wiblin
(74) *Attorney, Agent, or Firm* — Ked & Associates LLP

(57) ABSTRACT

A linear compressor includes a frame including a frame body, a frame head that extends from a front end of the frame body, a flange groove defined in the frame head, and a body hole that passes through the frame body; a cylinder including a cylinder body inserted into the body hole, a cylinder flange, and a cylinder head provided on a front end of the cylinder flange; and a lock ring press-fitted to be coupled to the flange groove and provided in a space defined between the cylinder head and an inner circumferential surface of the flange groove.

20 Claims, 7 Drawing Sheets

(51) Int. Cl.
*F04B 39/14* (2006.01)
*F04B 39/00* (2006.01)

(52) U.S. Cl.
CPC ..... *F04B 39/121* (2013.01); *F04B 39/14* (2013.01); *F04B 39/0061* (2013.01)

(58) Field of Classification Search
USPC ..... 417/417
See application file for complete search history.

(56) References Cited

U.S. PATENT DOCUMENTS

| | | | | |
|---|---|---|---|---|
| 2015/0004027 | A1 | 1/2015 | Kang et al. | |
| 2016/0017876 | A1* | 1/2016 | Kim | F04B 53/1035 417/443 |
| 2016/0108909 | A1* | 4/2016 | Fochtman | F04B 17/042 417/53 |
| 2017/0058889 | A1* | 3/2017 | Hoban | F04B 53/168 |
| 2017/0218934 | A1* | 8/2017 | Hebrard | F04B 39/126 |
| 2017/0298913 | A1* | 10/2017 | Kim | F04B 53/16 |
| 2017/0313292 | A1* | 11/2017 | Hanschek | B60T 11/236 |

FOREIGN PATENT DOCUMENTS

| | | | | |
|---|---|---|---|---|
| CN | 105298800 | | 2/2016 | |
| DE | 471950 C | * | 2/1929 | F04B 39/126 |
| KR | 10-2016-0024217 | | 3/2016 | |

OTHER PUBLICATIONS

U.S. Appl. No. 15/804,142, filed Nov. 6, 2017.
Chinese Office Action dated May 29, 2019 issued in Application No. 201710742471.3 (with English Translation).

* cited by examiner

LINEAR COMPRESSOR

CROSS-REFERENCE TO RELATED APPLICATION(S)

The present application is a Continuation of U.S. application Ser. No. 15/804,142, filed Nov. 6, 2017, which claims the benefits of priority to Korean Patent Application No. 10-2017-0078612 filed in Korea on Jun. 21, 2017, the entire contents of which are herein incorporated by reference.

BACKGROUND

Field

A linear compressor is disclosed herein.

2. Background

In general, compressors are machines that receive power from a power generation device, such as an electric motor or a turbine, to compress air, a refrigerant, or various working gases, thereby increasing a pressure thereof. Compressors are being widely used in home appliances or industrial fields.

Compressors may be largely classified into three different types. The first type is a reciprocating compressor, in which a compression space, into and/from which a working gas, such as a refrigerant, is suctioned and discharged, is defined between a piston and a cylinder to allow the piston to linearly reciprocate within the cylinder, thereby compressing the refrigerant. The second type is a rotary compressor, in which a compression space, into and/from which a working gas, such as a refrigerant, is suctioned or discharged, is defined between a roller that eccentrically rotates and a cylinder to allow the roller to eccentrically rotate along an inner wall of the cylinder, thereby compressing the refrigerant. The third type is a scroll compressor, in which a compression space into and/from which a working gas, such as a refrigerant, is suctioned or discharged, is defined between an orbiting scroll and a fixed scroll to compress the refrigerant while the orbiting scroll rotates along the fixed scroll.

A linear compressor is being widely developed which has a simple structure and which is directly connected to a drive motor, in which a piston linearly reciprocates, to improve compression efficiency without mechanical losses due to motion conversion. In general, the linear compressor suctions and compresses a refrigerant within a sealed shell while the piston linearly reciprocates within the cylinder by a linear motor and then discharges the compressed refrigerant.

The linear motor includes a permanent magnet provided between an inner stator and an outer stator. The permanent magnet is driven to linearly reciprocate by electromagnetic force between the permanent magnet and the inner (or outer) stator.

As the permanent magnet is connected to the piston, the refrigerant is suctioned and compressed while the piston linearly reciprocates within the cylinder and then the compressed refrigerant is discharged. A linear compressor is disclosed in related art Korean Patent Publication No. 2016-0024217, which is hereby is incorporated by reference, having a feature in which a coupling part protrudes from an outer circumferential surface of a flange of a cylinder, and a groove for seating the flange of the cylinder and the coupling part is defined in a top surface of a frame. Also, the cylinder is fixed to the frame through a coupling member, such as a bolt, passing through the coupling part.

As described above, in a case of the linear compressor in which the cylinder is coupled to the frame through the bolt, bolt coupling is performed at a plurality of points. Thus, if bolt coupling forces at the points are not completely the same, it is difficult to carry out a centering operation for aligning a center of the cylinder and a center of the frame.

When the center of the cylinder and the center of the frame do not match each other, it is difficult to form a gas passage through which a refrigerant gas for lubricating flows. That is, if the centering or alignment is not accurately performed, an outer circumferential surface of the cylinder and an inner circumferential surface of the frame may come into contact with each other, resulting in passage resistance because the gas passage is closed.

In addition, it is difficult to form the coupling part on the outer circumferential surface of the cylinder and form the groove for seating the coupling part in a top surface of the frame. Processing costs are also high.

A process for coupling equipment and parts is additionally required while the bolt is coupled, and thus, manufacturing costs increase. Also, a coupling force of the coupling member may be loosened due to vibration generated during driving of the compressor. As a result, vibration and noise may further increase, and the compressor may be deteriorated in reliability.

In order to solve the above-described limitations, a method of inserting and fixing the cylinder into an insertion hole in a press-fitting manner may be applied. However, in a case of the press-fitting manner, the cylinder may be deformed in shape by a high pressing force generated on the press-fitting surfaces of the cylinder and the frame. That is, an inner diameter of the cylinder may be deformed by the pressing force, and thus, the piston may not be properly inserted into the cylinder. Also, although the piston is inserted into the cylinder, the reciprocating motion of the piston may not be performed smoothly.

As vibration generated while the piston reciprocates is directly transmitted from the cylinder to the frame, when the piston reciprocates at a high frequency of 90 Hz or more, the vibration of the compressor may excessively increase. Also, when the outer circumferential surface of the cylinder is press-fitted into the frame, there may be no space between the cylinder and the frame. Thus, the cylinder may expand due to heat generated while a refrigerant is compressed at a high-temperature and high-pressure damaging the frame.

BRIEF DESCRIPTION OF THE DRAWINGS

Embodiments will be described in detail with reference to the following drawings in which like reference numerals refer to like elements, and wherein.

DETAILED DESCRIPTION

Figure 1:
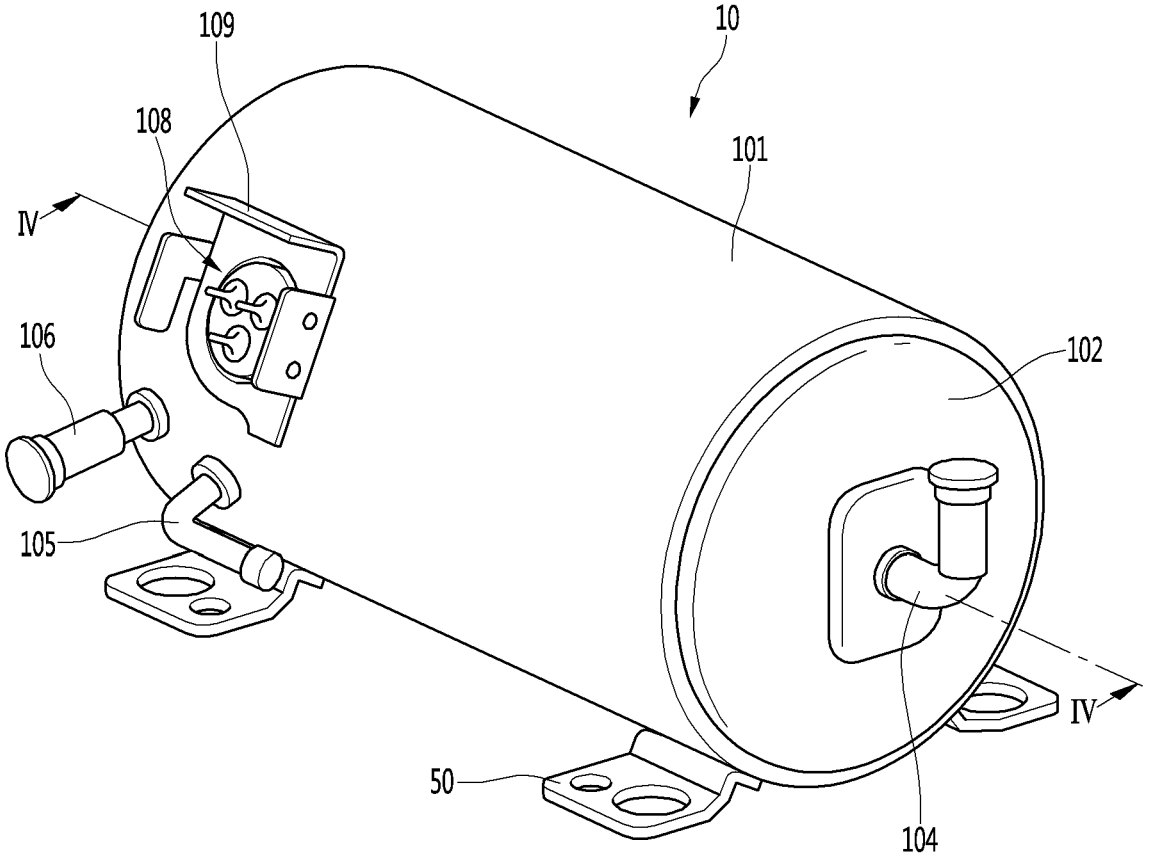
FIG. 1 is a perspective view illustrating an outer appearance of a linear compressor according to an embodiment.

Hereinafter, a linear compressor to which a coupling structure of a cylinder and a frame is applied according to an embodiment will be described with reference to the accompanying drawings. FIG. 1 is a perspective view illustrating an outer appearance of a linear compressor according to an embodiment, and FIG. 2 is an exploded perspective view illustrating a shell and a shell cover of the linear compressor according to an embodiment.

Figure 2:
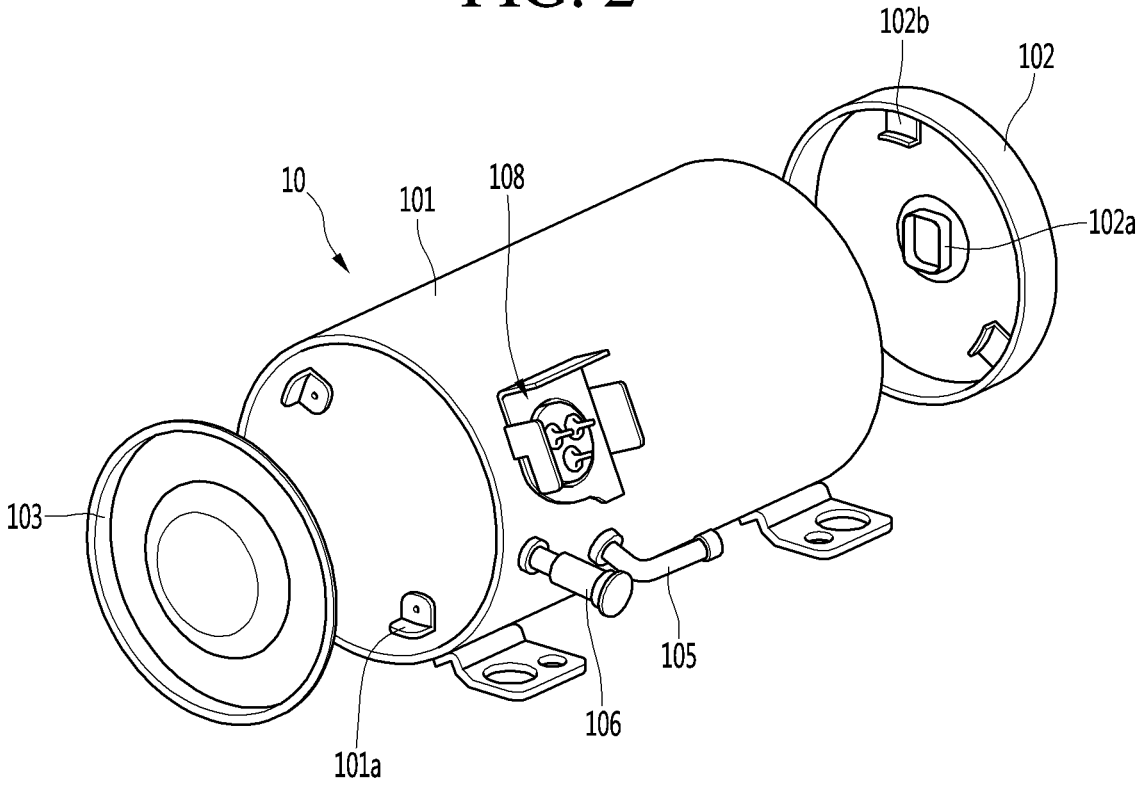
FIG. 2 is an exploded perspective view illustrating a shell and a shell cover of the linear compressor according to an embodiment.

Referring to FIGS. 1 and 2, a linear compressor 10 according to an embodiment may include a shell 101 and a shell cover coupled to the shell 101. The shell cover may include a first shell cover 102 and a second shell cover 103. Each of the shell covers 102 and 103 may be understood as one component of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit.

The shell 101 may have a horizontal cylindrical shape. Thus, when the linear compressor 10 is installed on the machine room base of the refrigerator, the machine room may be reduced in height. The shell 101 may have a cylindrical shape; however, embodiments are not limited thereto.

A terminal block 108 may be installed on an outer surface of the shell 101. The terminal block 108 may be a connection part that transmits external power to a motor assembly (see reference numeral 140 of FIG. 3) of the linear compressor 10. A bracket 109 may be installed outside the terminal block 108. The bracket 109 may protect the terminal block 108 against an external impact.

Both ends of the shell 101 may be open. The first and second shell covers 102 and 103 may be coupled to both the ends, that is, a first end and a second end of the shell 101, respectively. An inner space of the shell 101 may be sealed by the shell covers 102 and 103.

In FIG. 1, the first shell cover 102 may be provided at a first portion or end (right in the drawings) of the linear compressor 10, and the second shell cover 103 may be provided at a second portion or end (left in the drawings) of the linear compressor 10. That is, the first and second shell covers 102 and 103 may face each other. The linear compressor 10 may further include a plurality of pipes 104, 105, and 106 provided in the shell 101 or the shell covers 102 and 103 to suction and discharge a refrigerant.

The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which refrigerant may be supplemented to the linear compressor 10. For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be arranged at a position which is adjacent to the second shell cover 103 rather than the first shell cover 102.

The process pipe 106 may be coupled to an outer circumferential surface of the shell 101. A user may inject refrigerant into the linear compressor 10 through the process pipe 106. The process pipe 106 may be coupled to the shell 101 at a height different from a height of the discharge pipe 105 to avoid interference with the discharge pipe 105. The height may be a distance from the leg 50 in a vertical direction (or a radial direction). As the discharge pipe 105 and the process pipe 106 are coupled to the outer circumferential surface of the shell 101 at heights different from each other, work convenience may be improved.

A cover support part or bracket 102*a* may be provided on an inner surface of the first shell cover 102. A second support device (or second support) 185, which will be described hereinafter, may be coupled to the cover support part 102*a*. The cover support part 102*a* and the second support device 185 may support a main body of the linear compressor 10. The main body of the compressor may represent a component set provided in the shell 101. For example, the main body may include a drive part or drive that reciprocates forward and backward and a support part or support that supports the drive part.

Figure 3:
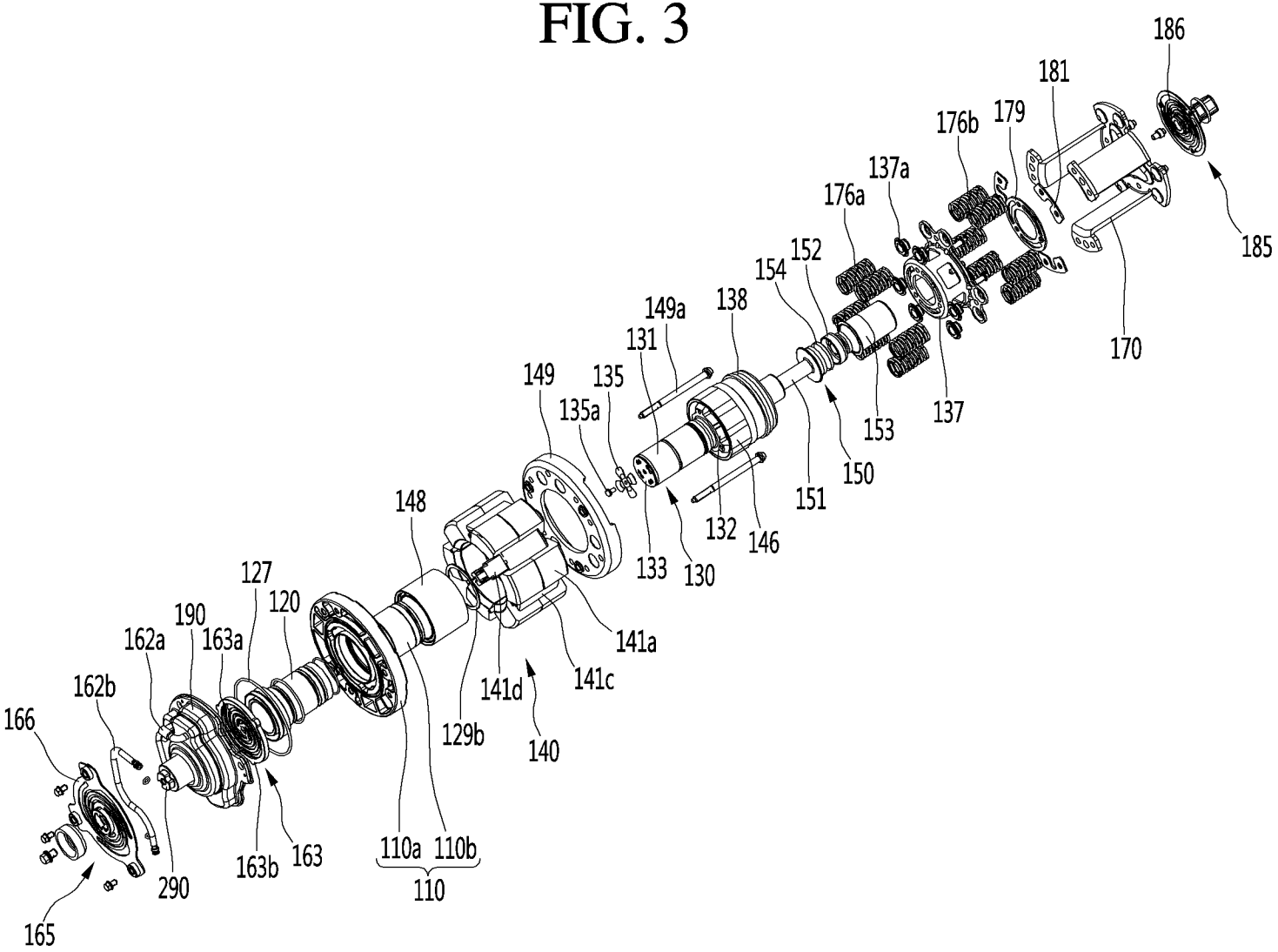
FIG. 3 is an exploded perspective view illustrating a main body of the linear compressor according to an embodiment.
Figure 4:
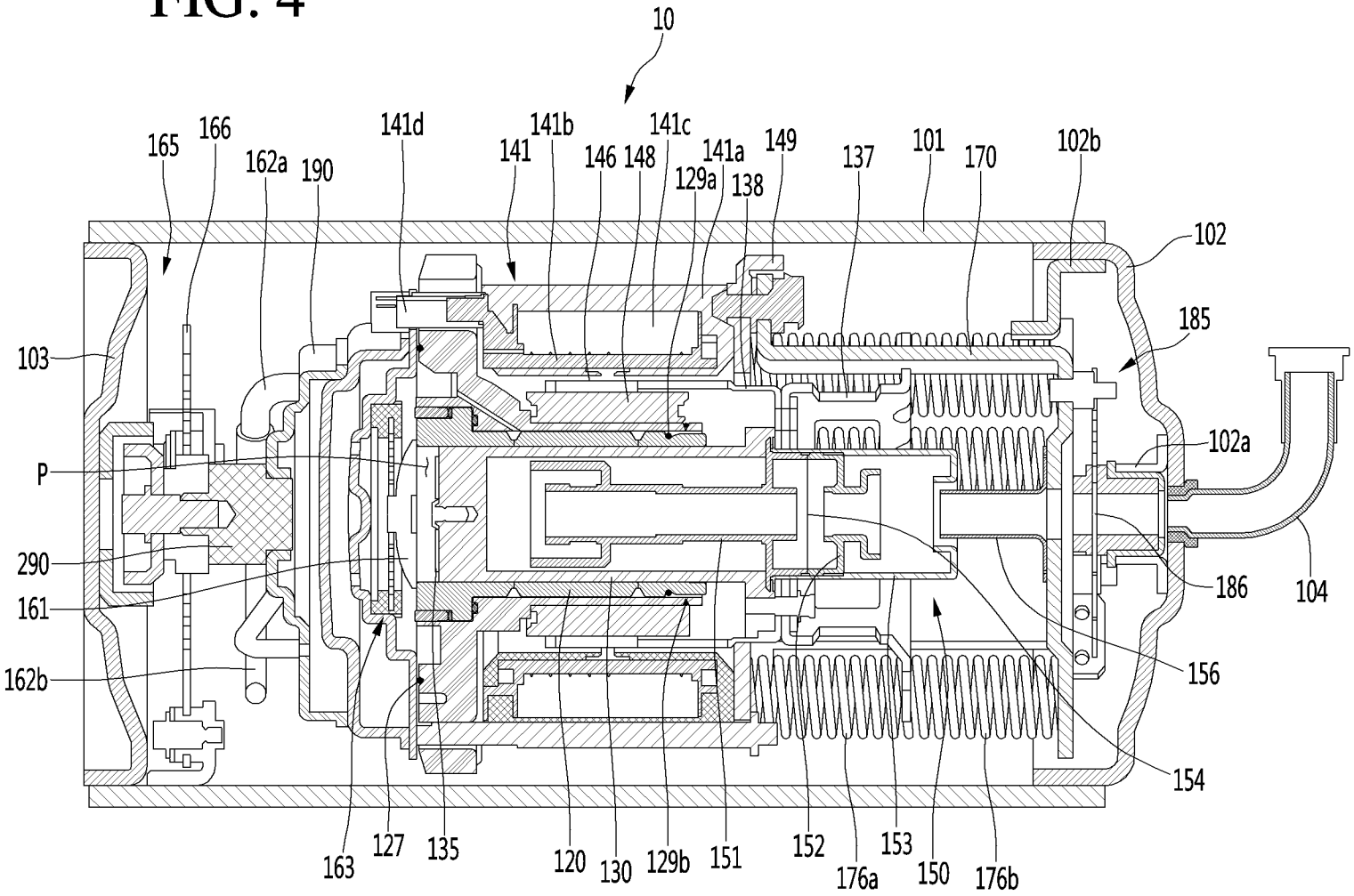
FIG. 4 is a longitudinal cross-sectional view of the linear compressor, taken along line IV-IV of FIG. 1, according to an embodiment.

As illustrated in FIGS. 3 and 4, the drive part may include components such as a piston 130, a magnet frame 138, a permanent magnet 146, a support 137, and a suction muffler 150. Also, the support part may include components such as resonant springs 176*a* and 176*b*, a rear cover 170, a stator cover 149, a first support device (or first support)165, and the second support device 185.

A stopper 102*b* may be provided on the inner surface of the first shell cover 102. The stopper 102*b* may be a component that prevents the main body of the compressor, particularly, the motor assembly 140, from colliding with the shell 101 and thus bearing damaged due to vibration or impact occurring during transportation of the linear compressor 10.

The stopper 102*b* may be adjacent to the rear cover 170, which will be described hereinafter. Thus, when the linear compressor 10 is shaken, the rear cover 170 may contact the stopper 102*b* to prevent the impact from being transmitted to the motor assembly 140.

A spring coupling part or coupler 101*a* may be provided on an inner surface of the shell 101. For example, the spring coupling part 101*a* may be provided at a position which is adjacent to the second shell cover 103. The spring coupling part 101*a* may be coupled to a first support spring 166 of the first support device 165, which will be described hereinafter. As the spring coupling part 101*a* and the second support device 600 are coupled to each other, the main body of the compressor may be stably supported inside the shell 101 without colliding with the shell 101.

FIG. 3 is an exploded perspective view illustrating the main body of the linear compressor according to an embodiment, and FIG. 4 is a longitudinal cross-sectional view of the linear compressor, taken along line IV-IV of FIG. 1, according to an embodiment. Referring to FIGS. 3 and 4, the main body of the liner compressor 10, which is provided in the shell 101, according to an embodiment may include a frame 110, cylinder 120 inserted into a center of the frame 110, a piston 130 linearly reciprocating within the cylinder 120, and motor assembly 140 that applies drive force to the piston 130. The motor assembly 140 may be a linear motor that allows the piston 130 to linearly reciprocate in the axial direction of the shell 101.

The linear compressor 10 may include suction muffler 150. The suction muffler 150 may be coupled to the piston 130 and configured to reduce noise generated from the refrigerant suctioned through the suction pipe 104. Also, the refrigerant suctioned through the suction pipe 104 may flow into the piston 130 via the suction muffler 150. For example, while the refrigerant passes through the suction muffler 150, a flow noise of the refrigerant may be reduced.

The suction muffler 150 may include a plurality of mufflers. The plurality of mufflers may include a first muffler 151, a second muffler 152, and a third muffler 153, which may be coupled to each other.

The first muffler 151 may be located within the piston 130, and the second muffler 152 may be coupled to a rear end of the first muffler 151. Also, the third muffler 153 may accommodate the second muffler 152 therein and may have a front end coupled to the rear end of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

A muffler filter 154 may be installed in the suction muffler 150. The muffler filter 154 may be provided at an interface at which the first muffler 151 and the second muffler 152 are coupled to each other. For example, the muffler filter 154 may have a circular shape, and an edge of the muffler filter 154 may be arranged and supported between coupling surfaces of the first and second mufflers 151 and 152.

The term "axial direction" may refer to a direction which is the same as a direction in which the piston 130 reciprocates, that is, an extension direction of a longitudinal central axis of the cylindrical shell 101. Also, in the "axial direction", a direction which is directed from the suction pipe 104 toward a compression space P, that is, a direction in which the refrigerant flows, may be defined as a "frontward direction", and a direction opposite to the frontward direction may be defined as a "rearward direction". When the piston 130 moves forward, the compression space P may be compressed. On the other hand, the term "radial direction" may be defined as a radial direction of the shell 101, that is, a direction perpendicular to the direction in which the piston 130 reciprocates.

The piston 130 may include a piston body 131 having an approximately cylindrical shape and a piston flange part (or piston flange) 132 extending from a rear end of the piston body 131 in the radial direction. The piston body 131 may reciprocate within the cylinder 120, and the piston flange part 132 may reciprocate outside the cylinder 120. The piston body 131 may accommodate at least a portion of the first muffler 151.

The cylinder 120 may include the compression space P in which the refrigerant may be compressed by the piston 130. Also, a plurality of suction holes 133 may be defined at positions spaced a predetermined distance from a center of a front surface of the piston body 131 in the radial direction.

The plurality of suction holes 133 may be spaced apart from each other along a circumferential direction of the piston 130, and the refrigerant may be introduced into the compression space P through the plurality of suction holes 133. The plurality of suction holes 133 may be spaced a predetermined distance from each other in a circumferential direction of the front surface of the piston 130, and a plurality of groups of the suction holes 133 may be provided.

A suction valve 135 that selectively opens the suction hole 133 may be provided at a front side of each of the suction holes 133. The suction valve 135 may be fixed to the front surface of the piston body 131 through a coupling member (or fastener) **135*a***, such as a screw or a bolt.

A discharge cover 190 defining a discharge space for the refrigerant discharged from the compression space P and a discharge valve assembly coupled to the discharge cover 190 to discharge the refrigerant compressed in the compression space P to the discharge space may be provided at a front side of the compression space P. The discharge cover 190 may be provided such that a plurality of covers are laminated.

The discharge valve assembly may include a discharge valve 161 and a spring assembly 163 that provides elastic force in a direction in which the discharge valve 161 is attached to a front end of the cylinder 120. When a pressure within the compression space P is above a discharge pressure, the discharge valve 161 may be separated from the front surface of the cylinder 120 to discharge the compressed refrigerant to the discharge space defined by the discharge cover 190. Also, when the pressure within the compression space P is above the discharge pressure, the spring assembly 163 may be contracted to allow the discharge valve 161 to be spaced apart from the front end of the cylinder 120.

The spring assembly 163 may include a valve spring **163*a* and a spring support part (or spring support) 163*b* that supports the valve spring 163*a* to the discharge cover 190. For example, the valve spring 163*a* may include a plate spring. The discharge valve 161 may be coupled to the valve spring 163*a*, and a rear portion or a rear surface of the discharge valve 161 may be attached and supported on the front surface (or the front end) of the cylinder 120**.

When the discharge valve 161 is supported on the front surface of the cylinder 120, the compression space P may be maintained in a sealed state. When the discharge valve 161 is spaced apart from the front surface of the cylinder 120, the compression space P may be opened to allow the refrigerant in the compression space P to be discharged.

The compression space P may be a space defined between the suction valve 135 and the discharge valve 161. Also, the suction valve 135 may be arranged at one side of the compression space P, that is, a first side, and the discharge valve 161 may be arranged at the other side of the compression space P, that is, an opposite or second side of the compression P.

While the piston 130 linearly reciprocates within the cylinder 120, when the pressure within the compression space P is less than a suction pressure of the refrigerant, the suction valve 135 may be opened to allow the refrigerant to be introduced into the compression space P. On the other hand, when the pressure within the compression space P is above the suction pressure, the suction valve 135 may be closed, and thus, the piston 130 may move forward to compress the refrigerant within the compression space P.

When the pressure within the compression space P is greater than a pressure (discharge pressure) of the first discharge space, the valve spring **163*a* may be deformed forward to allow the discharge valve 161 to be spaced apart from the cylinder 120. The refrigerant within the compression space P may be discharged into the discharge space through a gap between the discharge valve 161 and the cylinder 120. When the discharge of the refrigerant is completed, the valve spring 163*a* may provide a restoring force to the discharge valve 161 so that the discharge valve 161 may again contact the front end of the cylinder 120**.

The linear compressor 10 may further include a cover pipe 162*a*. The cover pipe 162*a* may be coupled to the discharge cover 190 to discharge the refrigerant flowing to the discharge space defined in the discharge cover 190 to the outside.

The linear compressor 10 may further include a loop pipe 162*b*. The loop pipe 162*b* may have a first end coupled to a discharge end of the cover pipe 162*a* and a second end connected to the discharge pipe 105 provided in the shell 101.

The loop pipe 162*b* may be made of a flexible material and have a length relatively longer than a length of the cover pipe 162*a*. The loop pipe 162*b* may extend from the cover pipe 162*a* along an inner circumferential surface of the shell 101 and be coupled to the discharge pipe 105.

The frame 110 may be a component to fix the cylinder 120. For example, the cylinder 120 may be inserted into a central portion of the frame 110. The discharge cover 190 may be coupled to a front surface of the frame 110 using a coupling member or fastener.

A cylinder support structure (or a cylinder support unit) to prevent the cylinder 120 from being separated while being inserted into the frame 110 may be provided. The cylinder support structure may include a lock ring 200 press-fitted into the frame 110. The cylinder support structure will now be described with reference to the accompanying drawings.

The motor assembly 140 may include an outer stator 141 fixed to the frame 110 to surround the cylinder 120, an inner stator 148 spaced inward from the outer stator 141, and the permanent magnet 146 provided in a space between the outer stator 141 and the inner stator 148. The permanent magnet 146 may linearly reciprocate by mutual electromagnetic force between the outer stator 141 and the inner stator 148. Also, the permanent magnet 146 may be a single magnet having one polarity or a plurality of magnets having three polarities coupled to each other.

The permanent magnet 146 may be provided on the magnet frame 138. The magnet frame 138 may have an approximately cylindrical shape and may be inserted into the space between the outer stator 141 and the inner stator 148.

The magnet frame 138 may be coupled to the piston flange part 132 to extend in the frontward direction (the axial direction). The permanent magnet 146 may be attached to a front end of the magnet frame 138 or an outer circumferential surface of the magnet frame 138. Thus, when the permanent magnet 146 reciprocates in the axial direction, the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. Also, the coil winding bodies 141*b*, 141*c*, and 141*d* may further include a terminal part (or terminal) 141*d* that guides a power line connected to the coil 141*c* so that the power line is led out or exposed to the outside of the outer stator 141.

The stator core 141*a* may include a plurality of core blocks in which a plurality of laminations are laminated in a circumferential direction. The plurality of core blocks may surround at least a portion of the coil winding bodies 141*b* and 141*c*.

Stator cover 149 may be arranged on or at one or a first side of the outer stator 141. That is, the outer stator 141 may have a first side supported by the frame 110 and a second side supported by the stator cover 149.

The linear compressor 10 may further include a cover coupling member (or cover fastener) 149*a* that couples the stator cover 149 to the frame 110. The cover coupling member 149*a* may pass through the stator cover 149 and extend forward to the frame 110 and may be coupled to the frame 110.

The inner stator 148 may be fixed to a circumference of the frame 110. Also, in the inner stator 148, the plurality of laminations may be stacked in the circumferential direction outside the frame 110.

The linear compressor 10 may further include support 137 that supports a rear end of the piston 130. The support 137 may be coupled to a rear portion of the piston 130 and may have a hollow part so that the muffler 150 may pass through an inside of the support 137. The piston flange part 132, the magnet frame 138, and the support 137 may be coupled to each other using a coupling member or fastener to form one body.

A balance weight 179 may be coupled to the support 137. A weight of the balance weight 179 may be determined based on a drive frequency range of the compressor body.

The linear compressor 10 may further include a rear cover 170. The rear cover 170 may be coupled to the stator cover 149 to extend backward and may be supported by the second support device 185.

The rear cover 170 may include three support legs, and the three support legs may be coupled to a rear surface of the stator cover 149. A spacer 181 may be provided between the three support legs and the rear surface of the stator cover 149. A distance from the stator cover 149 to a rear end of the rear cover 170 may be determined by adjusting a thickness of the spacer 181. Also, the rear cover 170 may be spring-supported by the support 137.

The linear compressor 10 may further include an inflow guide part (or inflow guide) 156 coupled to the rear cover 170 to guide an inflow of the refrigerant into the muffler 150. At least a portion of the inflow guide part 156 may be inserted into the suction muffler 150.

The linear compressor 10 may include a plurality of resonant springs 176 which may be adjustable in natural frequency to allow the piston 130 to perform a resonant motion. The plurality of resonant springs may include a plurality of first resonant springs 176*a* supported between the support 137 and the stator cover 149 and a plurality of second resonant springs 176*b* supported between the support 137 and the rear cover 170. Due operation of the plurality of resonant springs, the compressor body may stably reciprocate within the shell 101 of the linear compressor 10 to minimize the generation of vibration or noise due to movement of the compressor body.

The support 137 may include a first spring support part (or first spring support) 137*a* coupled to the first resonant spring 176*a*. The linear compressor 10 may include the frame 110 and a plurality of sealing members or seals to increase a coupling force between peripheral components around the frame 110.

The plurality of sealing members may include a first sealing member (or O-ring) 127 provided at a portion at which the frame 110 and the discharge cover 190 are coupled to each other. The plurality of sealing members may further include a third sealing member (or O-ring) 129*a* provided between the cylinder 120 and the frame 110.

The plurality of sealing members may further include a second sealing member (or O-ring) 129*a* provided at a portion at which the frame 110 and the inner stator 148 are coupled to each other. Each of the first to third sealing members 127, 129*a*, and 129*b* may have a ring shape.

The linear compressor 10 may further include the first support device 165 that supports the front end of the main body of the linear compressor 10. The first support device 165 may be coupled to a support coupling part (or support coupler) 290 of the discharge cover 190. The first support device 165 may be adjacent to the second shell cover 103 to elastically support the main body of the linear compressor 10. The first support device 165 may include a first support spring 166, and the first support spring 166 may be coupled to the spring coupling part 101*a*.

The linear compressor 10 may further include the second support device 185 that supports the rear end of the main body of the linear compressor 10. The second support device 185 may be coupled to the rear cover 170. The second support device 185 may be coupled to the first shell cover 102 to elastically support the main body of the compressor 10. The second support device 185 may include a second support spring 186, and the second support spring 186 may be coupled to the cover support part 102*a*. The frame 110 may include a frame head 110*a* having a disk shape and a frame body 110*b* extending from a center of a rear surface of the frame head 110*a* to accommodate the cylinder 120 therein.

Figure 5:
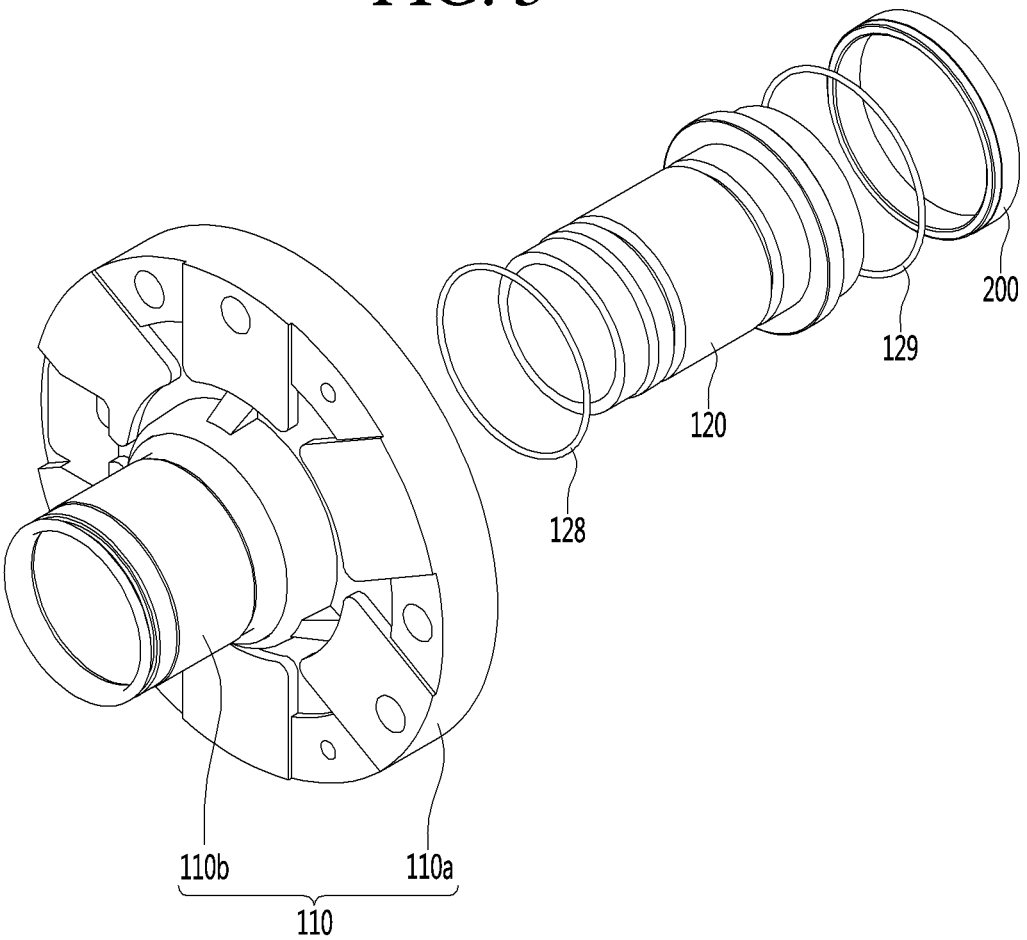
FIG. 5 is an exploded perspective view illustrating a coupling structure of a frame and a cylinder of the linear compressor according to an embodiment.
Figure 6:
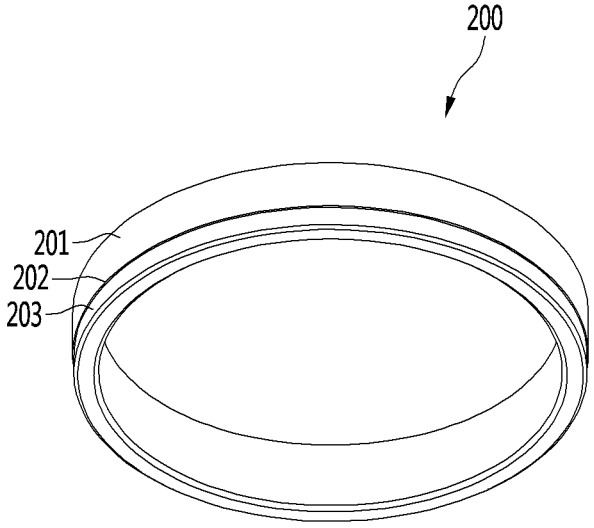
FIG. 6 is a perspective view of a cylinder lock ring according to an embodiment.
Figure 7:
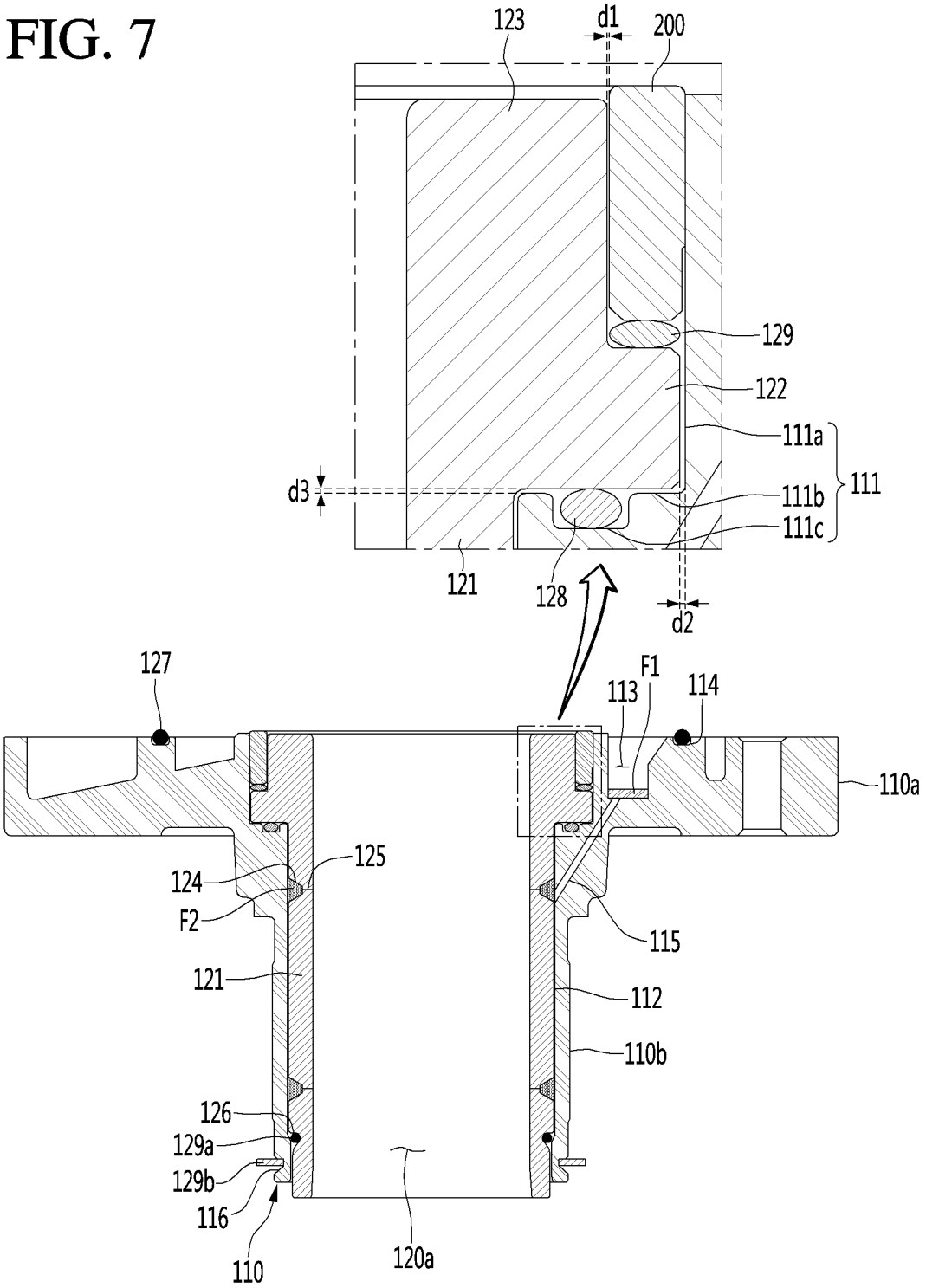
FIG. 7 is a cross-sectional view illustrating a coupled state of the cylinder and the frame.

FIG. 5 is an exploded perspective view illustrating a coupling structure of the frame and the cylinder of the linear compressor according to an embodiment. FIG. 6 is a perspective view of a cylinder lock ring according to an embodiment. FIG. 7 is a cross-sectional view illustrating a coupled state of the cylinder and the frame.

Referring to FIGS. 5 and 7, the linear compressor 10 according to an embodiment may include the frame 110, the cylinder 120 inserted into the frame 110, and a cylinder support structure that prevents the cylinder 120 from being separated from the frame 110 when the cylinder 120 is inserted into the frame 110. The cylinder 120 may include a cylinder body 121 having a cylindrical shape in which a piston accommodation part or bore 120*a* is defined therein, a cylinder head 123 arranged at a front end of the cylinder body 121 and having an outer diameter greater than an outer diameter of the cylinder body 121, and a cylinder flange 122 provided at a rear end of the cylinder head 123 and having an outer diameter greater than the outer diameter of the cylinder head 123. The outer diameter of the cylinder head 123 may not be larger than the outer diameter of the cylinder body. That is, the cylinder head 123 may have an outer diameter equal to or less than the outer diameter of the cylinder body 121.

An accommodation space (or a cylinder accommodation chamber) in which the cylinder 120 may be inserted may be defined in a central portion of the frame 110. The cylinder accommodation space may include a flange groove 111 recessed by a predetermined depth from a front surface of the frame head 110*a* and a body hole 112 that communicates with a rear end of the flange groove 111 and defined in the frame body 110*b*. The cylinder head 123 and the cylinder flange 122 may be accommodated in the flange groove 111, and the cylinder body 121 may be accommodated into the body hole 112. Thus, the flange groove 111 may have a diameter greater than a diameter of the body hole 112.

The flange groove 111 may include a side part or edge 111*a* facing a side surface (or a circumferential surface or an outer circumferential surface) of the cylinder flange 122 and a bottom part or edge 111*b* facing a rear surface (or a bottom surface) of the cylinder head 123. Also, a front end of the body hole 112 may communicate with the bottom part 111*b* of the flange groove 111.

The flange groove 111 may also have a radius greater by a predetermined length d2 than a radius of the cylinder flange 122. That is, a predetermined gap may be defined between the side surface of the cylinder flange 122 and the side part 111*a* of the flange groove 111 to prevent the frame 110 from being damaged by volume expansion of the cylinder flange 122.

The body hole 112 may have a diameter slightly greater than the outer diameter of the cylinder body 121 to allow the refrigerant gas to flow along a gap defined between the body hole 112 and the cylinder body 121. The lock ring 200 may be inserted into a space defined between an outer circumferential surface of the cylinder head 123 and the side part 111*a* of the flange groove 111. Thus, the space having a band shape, which is defined between the outer circumferential surface of the cylinder head 123 and the side part 111*a*, may be defined as a lock ring accommodation part.

The lock ring 200 may be made of a metal material and press-fitted to be coupled to the flange groove 111. That is, at least a portion of the lock ring 200 may have an outer diameter slightly greater than a diameter of the side part 111*a*, and the lock ring 200 may be press-fitted into the flange groove 111. Thus, the lock ring 200 may be firmly inserted into and fixed to the frame 110.

The lock ring 200 may have a circular band shape having a predetermined thickness and a length in the axial direction. An outer circumferential surface of the lock ring 200 may be divided into a pressing part (or first surface) 201 having an outer diameter equal to or slightly greater than a diameter of the side part 111*a* of the flange groove 111 and a spaced part (or second surface) 203 having an outer diameter less than the outer diameter of the pressing part 201.

A stepped part (or step) 202 generated by a difference in diameter may be provided at a boundary between the pressing part 201 and the spaced part 203. When the lock ring 200 is press-fitted to be coupled to the flange groove 111, the pressing part 201 may be attached to the side part 111*a* of the flange groove 111. On the other hand, the spaced part 203 may not come into contact with the side part 111*a*.

A press-fitting force required for the press-fit coupling may be determined according to a length of the pressing part 201 in the axial direction, that is, a length of the pressing part 201, which is measured in an extension direction of a central axis of the lock ring 200. That is, as the pressing part 201 increases in length, the press-fitting force may increase. Thus, the entire outer circumferential surface of the lock ring 200 may be defined as only the pressing part 201, or only a portion of the outer circumferential surface may be defined as the pressing part 201 according to design conditions. The pressing part 201 may have a length greater than, equal to, or less than a length of the spaced part 203 according to design conditions.

A hole having a cylindrical shape through which the cylinder head 123 may be inserted to pass therethrough may be defined in the lock ring 200. The hole may have a radius greater by a predetermined distance d1 than the outer diameter of the cylinder head 123. That is, the lock ring 200 may have an inner diameter greater by the distance d1 than the outer diameter of the cylinder head 123 to prevent the cylinder head 123 from coming into contact with the inner circumferential surface of the lock ring 200.

A smaller distance d1 between the cylinder head 123 and the lock ring 200 may be advantageous. This is done because leakage of the discharge refrigerant gas through the space of distance d1 may be minimized. Thus, the cylinder head 123 may have an outer diameter equal to or less than the outer diameter of the cylinder body 121. However, if the outer diameter of the cylinder head 123 is too small, the possibility of leakage of refrigerant may increase because the distance d1 is too large. On the other hand, to maintain the small distance d1, a thickness of the lock ring 200 may have to be excessively thick. Thus, the cylinder head 123 may have an outer diameter greater than the outer diameter of the cylinder body 121.

A press ring seat groove 111*c* having a predetermined depth and width may be provided in a band shape around the bottom part 111*b* of the flange groove 111. Also, a lower press ring 128 having a circular shape may be seated on the press ring seat groove 111*c*, and the lower press ring 128 may include an O-ring.

The lower press ring 128 may have a diameter greater than a depth of the press ring seat groove 111*c* and less than a width of the press ring seat groove 111*c*. Thus, when the cylinder head 123 is completely inserted into the flange groove 111, the lower press ring 128 may be compressed to completely or partially fill the press ring seat groove 111*c*.

A portion of the lower press ring 128 may protrude from the press ring seat groove 111*c* and thus may closely contact a bottom surface (or a rear surface) of the cylinder head 123. Also, the bottom surface of the cylinder head 123 may maintain a predetermined distance d3 from the bottom part 111*b* by the lower press ring 128.

An upper press ring 129 may be interposed between a bottom surface (or a rear end) of the lock ring 200 and a front surface (or a top surface) of the cylinder flange 122. The bottom surface of the lock ring 200 and the top surface of the cylinder flange 122 may not come into direct contact with each other due to the upper press ring 129.

According to the above-described structure, the outer circumferential surface of the cylinder 120 may maintain a predetermined distance from the inner circumferential surface of the cylinder accommodation part defined in the frame 110. Also, the phenomenon in which the cylinder 120 is separated forward from the frame 110 may be prevented by the lock ring 200.

As the cylinder 120 has no surface that comes into direct contact with the frame 110, vibration transmitted to the cylinder 120 may not be directly transmitted to the frame 110. That is, the vibration generated when the piston 130 linearly reciprocates, and the refrigerant is discharged may not be directly transmitted, but rather, may be substantially transmitted to the frame 110 through the upper press ring 129, the lower press ring 128, and the lock ring 200. As a result, a reduction in vibration and the noise may be maximized.

The cylinder 120 may be maintained in a state of being stably fixed to the inside of the frame 110 without using high press-fitting force, which may prevent an inner diameter of the cylinder 120 from being deformed or damaged while the cylinder 120 is assembled. One of the upper press ring 129 and the lower press ring 128 may be defined as a first press ring, and the other may be defined as a second press ring.

A groove into which the second sealing member 129*a* is fitted may be defined in an outer circumferential surface of a rear end of the cylinder body 121, and a groove into which the third sealing member 129*b* is fitted may be defined in a rear end of the outer circumferential surface of the frame body 110*b*. A gas inflow groove 124 which is recessed to introduce a portion of a high-temperature, high-pressure refrigerant gas discharged when the discharge valve 161 is opened may be defined in the outer circumferential surface of the cylinder body 121.

The gas inflow groove 124 may be defined in a band shape around the circumferential surface of the cylinder body 121. A plurality of gas inflow grooves 124 may be defined to be spaced a predetermined distance from each other along the outer circumferential surface of the cylinder body 121. In the drawings, although two gas inflow grooves 124 are defined in the outer circumferential surface of the cylinder body 121, embodiments are not limited thereto.

A cylinder filter F2 may be provided in the gas inflow groove 124 to filter foreign substances contained in the gas refrigerant introduced into the gas inflow groove 124. The gas inflow groove 124 may be tapered in a shape in which the gas inflow groove 124 has a width that gradually decreases to the inner circumferential surface of the cylinder body 121.

A gas nozzle 125 may be provided at a lower end (or a bottom part) of the gas inflow groove 124, and the gas nozzle 125 may pass through the inner circumferential surface of the cylinder body 121 to communicate with the piston accommodation part 120*a*. The gas nozzle 125 may be defined as a communication hole having a very small diameter. A plurality of gas nozzles 125 may be defined to be spaced a predetermined distance from each other along the gas inflow groove 124.

The gas refrigerant introduced into the piston accommodation part 120*a* through the plurality of gas nozzles 125 may flow between the outer circumferential surface of the piston 130 inserted into the piston accommodation part 120*a* and the inner circumferential surface of the cylinder body 121. When the piston 130 linearly reciprocates, the gas refrigerant introduced into the piston accommodation part 120*a* may perform a lubrication function to minimize friction generated between the outer circumferential surface of the piston 130 and the inner circumferential surface of the cylinder body 121.

A sealing groove 126 may be defined in an outer circumferential surface of the rear end of the cylinder body 121, and the second sealing member 129*a* may be fitted into the sealing groove 126. The high-temperature, high-pressure gas refrigerant introduced through the gap between the cylinder body 121 and the frame body 110*b* may be prevented from being discharged into the inner space of the shell 101, which is maintained in a low-pressure state, by the second sealing member 129*a*.

As described above, the frame 110 may include frame head 110*a* having a disk shape and frame body 110*b* extending in a cylinder shape from a center of a rear surface of the frame head 110*a*. A portion at which a rear surface of the frame head 110*a* and a front end of the frame body 110*b* meet each other may be a right angle. Alternatively, as illustrated in the drawings, the portion may be inclined or smoothly rounded, and the portion may be defined as a connection portion.

A frame groove 113 which is recessed at a predetermined depth may be defined at a point which is spaced apart from the flange groove 111 in the radial direction of the frame head 110*a*. A gas passage 115 may be provided in a bottom of the frame groove 113. The gas passage 115 may have an end that communicates with the body hole 112 of the frame body 110*b*. A discharge filter F1 may be provided on a bottom of the frame groove 113.

When the discharge valve 161 is opened, the high-temperature, high-pressure refrigerant gas existing in the compression space P may be discharged into the discharge space, and a portion of the discharged refrigerant gas may flow into the frame groove 113. While the refrigerant gas flowing to the frame groove 113 passes through the discharge filter F1, foreign substances contained in the refrigerant gas may be primarily filtered.

The refrigerant gas from which the foreign substances are primarily filtered may then be guided to the gas inflow groove 124 defined in the outer circumferential surface of the cylinder body 121. While the refrigerant gas guided to the gas inflow groove 124 passes through the cylinder filter F2, foreign substances may be secondarily filtered.

The refrigerant passing through the cylinder filter F2 may be guided to the piston accommodation part 120*a* through the gas nozzle 125. The piston 130 may linearly reciprocate in a state in which the piston 130 is inserted into the piston accommodation part 120*a*. Thus, the refrigerant gas guided to the piston accommodation part 120*a* through the gas nozzle 125 may flow between the outer circumferential surface of the piston 130 and the inner circumferential surface of the cylinder body 121 to function as a lubrication gas to prevent friction between the piston 130 and the cylinder body 121 from occurring.

The refrigerant gas flowing along the gas passage 115 may flow up to the rear end of the frame body 110*b* along the gap between the cylinder body 121 and the frame body 110*b*. Then, the refrigerant gas may be supplied into the plurality of gas inflow grooves 124 defined in the outer circumferential surface of the cylinder body 121. The refrigerant gas may be supplied into the body hole 112 through the plurality of gas nozzles 125 provided along each of the gas inflow grooves 124.

A sealing groove 114 may be defined in a portion of the front surface (or the top surface) of the frame head 110*a*, which corresponds to the outside of the frame groove 113, and the first sealing member 127 may be fitted into the sealing groove 114. When the discharge cover 190 is seated on the front surface of the frame head 110*a*, the high-temperature, high-pressure refrigerant gas discharged to the discharge cover 190 by the first sealing member 127 may not leak to the outside of the discharge cover 190.

The refrigerant supplied to the gap between the cylinder body 121 and the frame body 110*b* may be prevented from being discharged to the outside of the cylinder 120 by the second sealing member 129*a*. The sealing groove 116 may be defined in the outer circumferential surface adjacent to the rear end of the frame body 110*b*, and the inner stator 148 may be stably fixed to the outer circumferential surface of the frame body 110*b* by the third sealing member 129*b* fitted into the sealing groove 116.

A linear compressor including the foregoing components according to the embodiments may have at least following advantages. First, as the cylinder is coupled to the frame without a separate coupling member, the limitation of the linear compressor in which the cylinder is coupled to the frame through the screw according to the related art may be improved. That is, the limitation occurring due to the deformation in inner diameter of the cylinder may be improved or solved.

Second, as the cylinder is coupled to the frame without a separate coupling member, assembly process of the cylinder and the frame may be simplified. Third, as the cylinder is maintained in a state of being spaced apart from the frame by the press ring without coming into direct contact with the frame, a phenomenon in which vibration generated while the piston reciprocates is transmitted to the frame may be minimized. Fourth, as the cylinder is maintained in a state of being spaced apart from the inner circumferential surface of the frame, even though the cylinder is expanded in volume due to the high-temperature, high-pressure refrigerant, the possibility of damage of the frame may be significantly reduced.

A linear compressor according to embodiments may include a compressor body; and a shell that accommodates the compressor body. The compressor body may include a frame including a frame body that extends in a longitudinal direction of the shell, a frame head that extends from a front end of the frame body in a direction perpendicular to the extension direction of the frame body, a flange groove defined in a central portion of the frame head, and a body hole that passes through a central portion of the frame body to communicate with the flange groove; a cylinder including a cylinder body inserted into the body hole, a cylinder flange having an outer diameter greater than an outer diameter of the cylinder body and protruding from an outer circumferential surface of the cylinder body, and a cylinder head disposed or provided on or at a front end of the cylinder flange and having an outer diameter less than the outer diameter of the cylinder flange; and a lock ring press-fitted to be coupled to the flange groove and disposed or provided in a spaced space defined between the cylinder head and an inner circumferential surface of the flange groove. The cylinder head may have an outer diameter greater than the outer diameter of the cylinder body.

The lock ring may be press-fitted to be coupled to the flange groove. The flange groove may include a side part or side that faces an outer circumferential surface of the lock ring; and a bottom part or bottom perpendicular to the side part. The body hole may pass through the bottom part to communicate with the flange groove.

The outer circumferential surface of the lock ring may include a first surface closely attached to the side part of the flange groove; a second surface having an outer diameter less than that of the press part; and a step defining a boundary between the press part and the spaced part. The cylinder head may have a side surface spaced a predetermined distance from an inner circumferential surface.

The cylinder flange may have a side surface spaced a predetermined distance from the side part of the flange groove. The cylinder flange may have a rear surface spaced a predetermined distance from the bottom part of the flange groove.

The linear compressor according to embodiments may further include a first press ring interposed between a rear surface of the lock ring and a front surface of the cylinder flange; and a second press ring interposed between a rear surface of the cylinder flange and the bottom part of the flange groove. The frame may include a press ring seat groove which may be recessed from the bottom part of the flange groove and on which the second press ring may be seated. The rear surface of the cylinder flange may be spaced a predetermined distance from the bottom part of the flange groove by allowing the second press ring to come into contact with the rear surface of the cylinder flange.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell;

a frame received in the shell, an outer surface of the frame being spaced apart from an inner surface of the shell;

a cylinder inserted in an accommodation hole which passes through the frame; and lock ring, a portion of an outer surface of which is press-fitted into the accommodation hole of the frame, wherein an inner surface of the lock ring is configured to encircle a portion of an outer surface of the cylinder, wherein the outer surface of the cylinder facing the inner surface of the lock ring is spaced apart from the inner surface of the lock ring so as not to contact an entire inner surface of the lock ring.

2. The linear compressor according to claim 1, wherein the frame includes:

a frame body extending in a first direction; and a frame head extending in a second direction from a first end of the frame body, wherein the first direction is perpendicular to the second direction.

3. The linear compressor according to claim 2, wherein the accommodation hole includes:

a flange groove formed at a junction between the frame body and the frame head, the flange groove being configured to receive a first portion of the cylinder and having:

a bottom part; and a side part vertically extending from an outer edge of the bottom part; and a body hole passing through the frame body to communicate with the flange groove and configured to receive a second portion of the cylinder.

4. The linear compressor according to claim 3, wherein the cylinder includes:

a cylinder body inserted into the body hole;

a cylinder head received in the flange groove and having an outer diameter greater than an outer diameter of the cylinder body at a first end of the cylinder body; and a cylinder flange formed between the cylinder body and the cylinder head to be received in the flange groove and having an outer diameter greater than the outer diameter of the cylinder head.

5. The linear compressor according to claim 4, wherein the outer surface of the lock ring includes:

a first surface having a diameter equal to or greater than a diameter of the side part of the flange groove;

a second surface spaced part having an outer diameter less than the outer diameter of the first surface; and a stepped part defined at a boundary between the first surface and the second surface.

6. The linear compressor according to claim 4, further comprising at least one press ring provided at a position in a gap which is defined by an outer surface of the cylinder and an inner surface of the frame to form the accommodation hole.

7. The linear compressor according to claim 6, wherein the at least one press ring includes a first press ring provided between the lock ring and the cylinder flange, wherein the first ring is mounted on a front surface of the cylinder flange, and wherein the lock ring is mounted on the first press ring.

8. The linear compressor according to claim 6, wherein the at least one press ring includes a second press ring provided between a rear surface of the cylinder flange and the bottom part of the flange groove.

9. The linear compressor according to claim 8, wherein the frame further includes a press ring seat groove recessed from the bottom part of the flange groove and in which the second press ring is seated.

10. The linear compressor according to claim 9, wherein the rear surface of the cylinder flange is spaced a predetermined distance from the bottom part of the flange groove to allow the second press ring to come into contact with the rear surface of the cylinder flange.

11. The linear compressor according to claim 4, wherein the inner surface of the lock ring is spaced apart from an outer surface of the cylinder head.

12. The linear compressor according to claim 4, wherein a side surface of the cylinder flange is spaced apart from the side part of the flange groove.

13. A linear compressor, comprising:

a shell;

a frame received in the shell, an outer surface of the frame being spaced apart from an inner surface of the shell;

a cylinder inserted in an accommodation hole which passes through the frame; and a lock ring, a portion of an outer surface of which is press-fitted into the accommodation hole of the frame, wherein an inner circumferential surface of the lock ring is configured to encircle a portion of an outer surface of the cylinder, wherein the frame includes:

a frame body extending in a first direction; and a frame head extending in a second direction from a first end of the frame body, wherein the accommodation hole includes:

a flange groove formed at a junction between the frame body and the frame head, the flange groove being configured to receive a first portion of the cylinder and having:

a bottom part; and a side part vertically extending from an outer edge of the bottom part; and a body hole passing through the frame body to communicate with the flange groove and configured to receive a second portion of the cylinder, and wherein the cylinder includes:

a cylinder body inserted into the body hole;

a cylinder head received in the flange groove and having an outer diameter greater than an outer diameter of the cylinder body at a first end of the cylinder body; and a cylinder flange formed between the cylinder body and the cylinder head to be received in the flange groove and having an outer diameter greater than the outer diameter of the cylinder head.

14. The linear compressor according to claim 13, wherein the outer surface of the lock ring includes:

a first surface having a diameter equal to or greater than a diameter of the side part of the flange groove;

a second surface spaced part having an outer diameter less than the outer diameter of the first surface; and a stepped part defined at a boundary between the first surface and the second surface.

15. The linear compressor according to claim 13, further comprising at least one press ring provided at a position in a gap which is defined by an outer surface of the cylinder and an inner surface of the frame to form the accommodation hole.

16. The linear compressor according to claim 15, wherein the at least one press ring includes a first press ring provided between the lock ring and the cylinder flange, wherein the first ring is mounted on a front surface of the cylinder flange, and wherein the lock ring is mounted on the first press ring.

17. The linear compressor according to claim 15, wherein the at least one press ring includes a second press ring provided between a rear surface of the cylinder flange and the bottom part of the flange groove.

18. The linear compressor according to claim 17, wherein the frame further includes a press ring seat groove recessed from the bottom part of the flange groove and in which the second press ring is seated, and wherein the rear surface of the cylinder flange is spaced a predetermined distance from the bottom part of the flange groove to allow the second press ring to come into contact with the rear surface of the cylinder flange.

19. The linear compressor according to claim 13, wherein the inner circumferential surface of the lock ring is spaced apart from an outer surface of the cylinder head.

20. The linear compressor according to claim 13, wherein a side surface of the cylinder flange is spaced apart from the side part of the flange groove.

* * * * *